US005155535A

United States Patent [19]

Bermel et al.

[11] Patent Number: 5,155,535

[45] Date of Patent: * Oct. 13, 1992

[54] TRANSFER APPARATUS HAVING A TRANSFER MEMBER WITH VACUUM MEANS

[75] Inventors: Marcus S. Bermel, Rochester; Robert I. Edelman, Pittsford; David J. Ellingham, Rochester; William B. Vreeland, Webster, all of N.Y.

[73] Assignee: Eastman Kodak Company, Rochester, N.Y.

[ * ] Notice: The portion of the term of this patent subsequent to Apr. 9, 2008 has been disclaimed.

[21] Appl. No.: 375,240

[22] Filed: Jul. 3, 1989

[51] Int. Cl.[5] ..... G03G 15/16; G03G 21/00

[52] U.S. Cl. ..... 355/274; 355/312; 355/326

[58] Field of Search ..... 355/271, 274, 277, 326, 355/327, 312

[56] References Cited

U.S. PATENT DOCUMENTS

| | | | |
|---|---|---|---|
| 3,633,543 | 1/1972 | Pitasi | 355/272 X |
| 3,781,105 | 12/1973 | Meagher | 355/274 |
| 3,832,055 | 8/1974 | Hamaker | 355/274 |
| 3,900,591 | 8/1975 | Kline | 355/282 X |
| 4,080,053 | 3/1978 | Friday | 355/271 |
| 4,272,181 | 6/1981 | Treseder | 355/319 |
| 4,403,847 | 9/1983 | Chrestensen | 355/277 |
| 4,712,906 | 12/1987 | Bothner et al. | 355/271 |
| 4,739,361 | 4/1988 | Roy et al. | 355/277 |
| 4,740,813 | 4/1988 | Roy | 355/274 |
| 4,914,482 | 4/1990 | Ammenheuser et al. | 355/271 |
| 4,914,483 | 4/1990 | Paxon | 355/271 |
| 5,006,900 | 4/1991 | Baughman et al. | 355/271 |

*Primary Examiner*—Fred L. Braun

*Attorney, Agent, or Firm*—Leonard W. Treash

[57] ABSTRACT

A transfer member, for example, a transfer drum utilizes a vacuum applied through vacuum openings to the drum surface for holding a receiving sheet. A toner image is transferred to the sheet under the urging of an electric field. The vacuum openings are made small enough to prevent a visible artifact caused by nontransfer of toner in the vicinity of the opening but large enough to still maintain a vacuum contributing to the holding force of the sheet. According to a preferred embodiment, larger vacuum holes are formed in the drum and a conductive insert defining or helping define small vacuum openings is inserted in each vacuum hole. The insert maintains the continuity of the electric field in the hole region, but its geometry provides the small openings to maintain the vacuum. The invention is particularly useful in apparatus in which more than one color toner image is transferred in registry to the receiving sheet.

24 Claims, 7 Drawing Sheets

TRANSFER APPARATUS HAVING A TRANSFER MEMBER WITH VACUUM MEANS

RELATED APPLICATIONS

This application is related to co-assigned:

U.S. patent application Ser. No. 07/375,105, now U.S. Pat. No. 4,949,129, issued Aug. 14, 1990, filed Jul. 3, 1989. APPARATUS FOR TRANSFERRING TONER IMAGES TO A RECEIVING SHEET, William Y. Fowlkes et al.

U.S. patent application Ser. No. 07/375,165, now U.S. Pat. No. 4,941,020, issued Jul. 10, 1990. filed Jul. 3, 1989, TRANSFER APPARATUS HAVING VACUUM HOLES FOR HOLDING A RECEIVING SHEET, Richard C. Baughman et al.

U.S. patent application Ser. No. 07/375,110, now U.S. Pat. No. 5,006,900, issued Apr. 9, 1991. filed Jul. 3, 1989, TRANSFER APPARATUS HAVING VACUUM HOLES AND METHOD OF MAKING SUCH APPARATUS, Richard C. Baughman et al.

TECHNICAL FIELD

This invention relates to apparatus for transferring electrostatically held toner images to a receiving sheet. More specifically, this invention relates to such apparatus including a transfer roller or drum having vacuum holes or the like for holding the receiving sheet as it passes through transfer relation with a toner image.

BACKGROUND OF THE INVENTION

U.S. Pat. No. 4,712,906, Bothner et al, shows an electrophotographic color printer which forms consecutive images in different colors that are transferred in registry to a receiving sheet. The receiving sheet is wrapped on a transfer drum or roller and recirculated on the surface of the drum into transfer relation with the consecutive images to create a multicolor image on the sheets. To improve efficiency, large sheets, for example, "ledger" size sheets are placed on the drum with the small dimension parallel to the axis of the drum and wrapped substantially around the transfer drum. Small sheets, for example, "letter" size sheets are placed with their long dimension parallel to the axis of the drum. Since the short dimension of letter size sheets is approximately half the long dimension of ledger size sheets, two letter size sheets are placed on the drum in approximately the same space as the single ledger size sheet.

Prior to the Bothner invention, commercial color image transfer devices secured the receiving sheet to the transfer drum with small gripping fingers that grip the leading edge of the sheet. Many other methods are mentioned in the literature, for example, vacuum holes, electrostatics or combinations of vacuum holes, electrostatics and gripping fingers. The gripping fingers were preferred commercially because they more firmly hold the sheet against slippage, which slippage would degrade the registration of the images.

However, the Bothner invention is difficult to utilize with gripping fingers because the leading edge of the second letter size sheet is positioned at approximately the middle of a ledger size sheet. For some applications, retractable fingers may be made to work, but for many applications they would leave substantial image artifacts in a ledger size sheet. Bothner therefore suggests the use of vacuum holes which are positioned at the leading edge of each of the smaller sheets and may or may not both be activated for the ledger size sheet.

To firmly hold fairly heavy stock the holes were made as large as 3–6 mm in diameter and placed less than one to a centimeter in a line across the drum.

The vacuum holes shown in Bothner work fine in many situations. However, under some conditions, the vacuum holes show up on the final image as small round areas of incomplete toner transfer. This is especially true in dry ambient conditions, with transparency receiving stock, and with the second transfer to duplex receiving sheets where the receiving sheet has been dried by a prior fusing step.

Even in dry conditions, the artifacts may be acceptable if they were confined to the leading edge of all sheets where image information is unlikely. However, the Bothner apparatus forces at least one line of vacuum holes for the leading edge of the second small sheet, to the middle of a large sheet. Further, in different sheet holding applications, it may be necessary to put vacuum holes at the trailing edge as well as the leading edge of at least some sheets. If a variety of sheet sizes is to be available, many lines of trailing edge holes will be necessary. Vacuum holes on the trailing edges of a variety of sheets place many lines of holes in the middle of larger sheets, depending on the mixture of sizes available in the machine.

U.S. Pat. No. 4,080,053, Friday, shows a vacuum web transport for a copy sheet through a transfer station having a rather lengthy transfer area formed by parallel portions of the transfer web and a photoconductive web. To prevent what the reference termed "vacuum hole printout", the effective position of the holes is gradually moved to different locations during passage through the transfer zone. Whatever the effectiveness of this solution for the apparatus shown, it would not be useful with the relatively small transfer zone formed by a transfer drum with either an image carrying web or drum.

The Bothner apparatus shows a transfer drum having an aluminum base with a polyurethane coating of intermediate conductivity. The layer of intermediate conductivity allows the creation of a relatively strong transfer electric field without electrical breakdown in the nip. It is believed that the failure to transfer toner over a vacuum hole is due to lack of continuity of the electric field in that region when a less conductive, for example, a dryed out transfer sheet is being used.

DISCLOSURE OF THE INVENTION

It is the object of the invention to provide an apparatus for transferring electrostatically held toner images to a receiving sheet, which receiving sheet is held by a vacuum to a transfer member, with a reduction of the aforementioned image defect associated with vacuum holes.

We have found that a vacuum opening can be made small enough that the electrical field controlling transfer is not disrupted to an extent creating a visibly unacceptable artifact but is large enough that the vacuum can be maintained despite the presence of paper dust, toner and fusing oil in the system. Preferably, for systems such as that shown in the Bothner et al patent a vacuum opening having a maximum dimension at the surface of the drum that is less than 1.0 mm provides this effect when holding substantially dry paper. For highest quality work with very dry paper, openings between 0.5 and 0.65 mm are preferred. For extremely insulative receiving sheets, for example, transparency stock, openings as small as 0.35 mm are preferred.

According to an embodiment of the invention, openings of such small diameter can be drilled thorugh the transfer drum, for example, by using a laser or other fine diameter drilling mechanism.

However, according to an alternative and preferred embodiment of the invention, conductive inserts are positioned in large diameter vacuum holes which inserts form a continuous surface for the roller with the rest of the roller surface. The inserts are sufficiently conductive to improve the continuity of the electric field affecting transfer. The geometry of the inserts provide appropriately small vacuum openings through which the vacuum may be maintained. With this preferred embodiment, the small openings are narrow enough in cross-section that they produce little or no noticeable defect in the final print. They have ease of manufacturing advantages over drilled openings and can be made shorter than drilled openings thereby being less likely to become clogged with toner, paper dust, toner fusing oil and other materials unfortunately randomly present in this type of apparatus. Thus, according to a further preferred embodiment of the invention, the geometry of the inserts is such that the vacuum openings created are substantially shorter in length than the original vacuum holes themselves. This shortness in length better solves the problem of the clogging of the openings, surprisingly, without substantially detracting from the electrical field in the area of the vacuum hole.

According to a further preferred embodiment of the invention the conductive insert has a cylindrical outer surface and a hollow center with one end open and the other closed. The closed end has the small vacuum openings from the outside of the closed end to the hollow center. The cylindrical outer surface is considerably longer than the vacuum openings in the closed end and is adhesively fixed to the insides of the vacuum holes. With this structure the long exterior cylindrical surface can be better electrically connected to the rest of the outer layer of the transfer member while the insert still provides the very short length to the vacuum openings which prevent clogging in use.

According to another preferred embodiment, the inserts have a splined, knurled, serrated or similarly formed outer surface, which cooperates with the vacuum hole walls to create a ring of small openings adjoining the walls. This structure provides good results and has the advantage of ease of manufacture compared to other geometries.

According to another preferred embodiment, vacuum openings are formed which are wider at their base than they are at the surface of the transfer drum. The wide base discourages clogging while the narrow top to the opening reduces the artifact.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
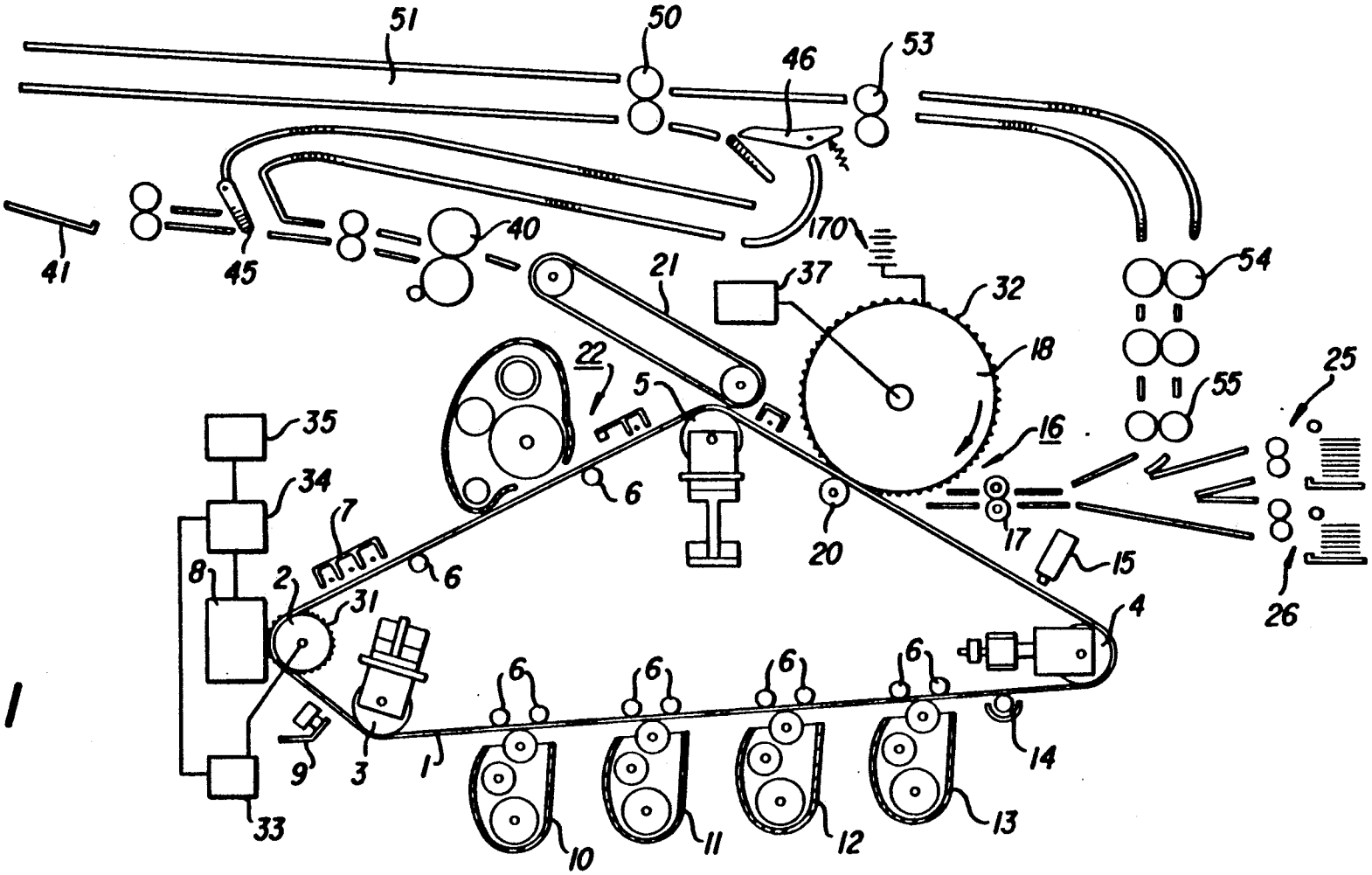
FIG. 1 is a schematic side view of a printer constructed according to the invention, with many parts eliminated for clarity of illustration.

According to FIG. 1 a film core portion of a copier or printer includes an image bearing member, for example, an endless electrophotoconductive web 1 entrained about a series of primary rollers 2, 3, 4 and 5, and other supporting structure, for example, film skis 6.

Web 1 is driven through a series of electrophotographic stations generally well-known in the art. More specifically, a uniform charge is laid down on the web 1 by a charging station 7. The uniformly charged web moves around printhead roller 2 which is directly opposite an LED printhead 8 which LED printhead exposes the web 1 in a manner well-known in the art. The web then moves into operative relation with an electrometer 9 which senses the level of a charge existing after exposure of the web by printhead 8, to help control the process.

The web then moves into operative relation with a series of toning or developing stations 10, 11, 12 and 13. Each image created by printhead 8 is toned by one of the toning stations. After being toned the web passes a magnetic scavenger 14 which removes excess iron particles picked up in the toning process. After the electrostatic image has been toned the web passes under a densitometer 15 which measures the density of the toner image also for use in controlling the process. The toner image then proceeds to a transfer station 16 where the image is transferred to a transfer surface of a receiving sheet carried by a transfer drum 18.

The transfer drum 18 includes vacuum holes 19 (FIGS. 2–3) for securing the receiving sheet thereto for repeated presentations to web 1. The transfer drum 18 cooperates with web 1 to incrementally bring the receiving sheet and the toner image into transfer relation so that the toner image is transferred to the receiving sheet. As is well known in the art, this is generally accomplished in the presence of an electric field which is created by biasing the transfer drum by a suitable biasing means, for example, electrical source 170, compared to the conductive layer of the web 1 or to a backing roller 20 for the web. This process has been well-known in the art for many years, see for example, U.S. Pat. No. 3,702,482. Although either the web 1 or the drum 18 could be at ground, conventionally the conductive backing is at ground and the drum at a relatively high voltage. For example, if the toner to be transferred is positively charged, the drum can be biased to −3000 V by electrical source 170.

As thoroughly discussed in U.S. Pat. No. 4,712,906, cited above, when the apparatus is operating in a multi-image mode, for example, a multicolor mode, consecutive images or pairs of images are toned with different colored toners using the different toning stations 10—13. These consecutive images are transferred in registry to the receiving sheet as it repeatedly is brought into transfer relation with the web 1 by the drum 18. After the transfer operation is complete, the receiving sheet is allowed to follow the web, for example, by removing the vacuum holding it to the drum 18 or by stripping the sheet with a skive, other conventional stripping mechanism, or both. The receiving sheet is separated from the web with the aid of an electrostatic sheet transport mechanism 21 and is transported to a fuser 40. The web is then cleaned by the application of a neutralizing corona and a neutralizing erase lamp and a magnetic brush cleaning mechanism all located at a cleaning station 22.

Figure 2:
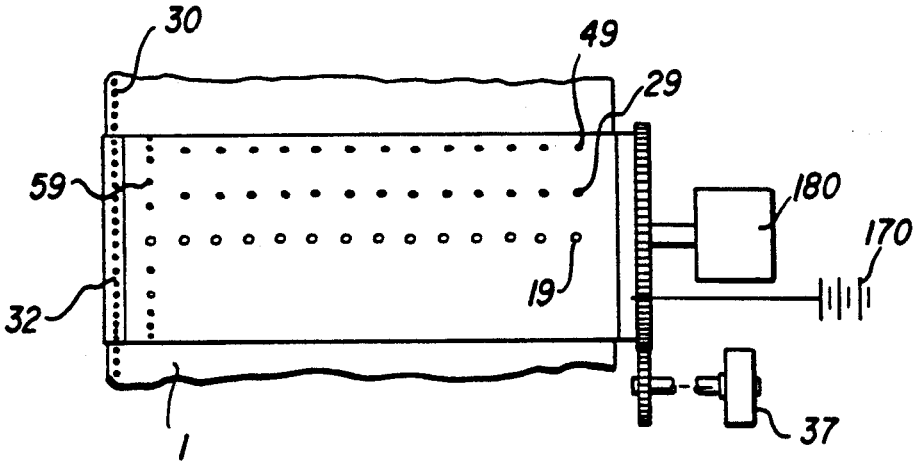
FIG. 2 is a top view of a portion of a transfer apparatus in which the invention is usable.

The transfer drum 18 is driven by a motor 37, the drum 18 in turn driving the web 1 through a sprocket 32 which engages perforations 30 (FIG. 2). The sprocket 32 also forms part of a registration and timing system which includes a sprocket 31 on printhead roller 2 which sprocket is linked to an encoder 33. The encoder 33 feeds signals indicative of the angular position of sprocket 31 to a drive 34 for the printhead 8 which drive 34 times the application of information from an information source 35 to the printhead 8.

After the receiving sheet leaves the fuser 40 it can go directly to an output tray 41 or be deflected by a deflector 45 into a duplex path according to the position of deflector 45, the position of which is controlled by the logic of the apparatus through means not shown. The duplex path moves the sheet by rollers and guides directing it first through a passive deflector 46 into turn-around rollers 50. Turn-around rollers 50 are independently driven to drive the receiving sheet into turn-around guide means 51 until the trailing edge thereof has been sensed by an appropriate sensor, not shown, to have passed passive diverter 46. Once the trailing edge has passed passive diverter 46 the turn-around rollers 50 are reversed and the receiving sheet is driven by rollers 50 and other sets of drive rollers 52, 53, and 54 back to a position upstream of the transfer station 16. The receiving sheet can pass through registration mechanisms for correcting for skew, crosstrack misalignment and in-track misalignment and ultimately stop at alignment rollers 55.

Transfer station 16 receives sheets from any of three sources. First, it can receive sheets of one particular size from a first supply 25, which first supply may include, for example, letter size sheets being fed with their short dimension parallel with the direction of feed. Second, it may receive sheets from a second supply 26, which, for example, may include ledger size sheets with their long dimension parallel to the direction of movement. Third, the transfer station 16 may receive sheets from the duplex path as controlled by rollers 55 which may include either size sheet and would already contain a fused image on its upper side. The receiving sheets from whatever source, stop against timing rollers 17. In response to a signal from the logic and control of the apparatus, not shown, timing rollers 17 accelerate to drive the receiving sheet into the nip between the transfer drum 18 and the web 1 as the first toner image to be transferred approaches the nip.

The duplex path is of a length that takes multiple sheets at one time depending on the length of the sheets. For example, four letter size sheets may be in the duplex path at one time or two ledger size sheets. If the printer is printing different images on different sheets, the logic and control of the apparatus must supply the necessary programming to the exposure and toning stations so that the sheets ultimately fed to the output tray 41 are in the correct order considering the number of sheets that must be in the duplex path. Such programming is known in the art, see, for example, U.S. Pat. No. 4,453,841.

Figure 3:
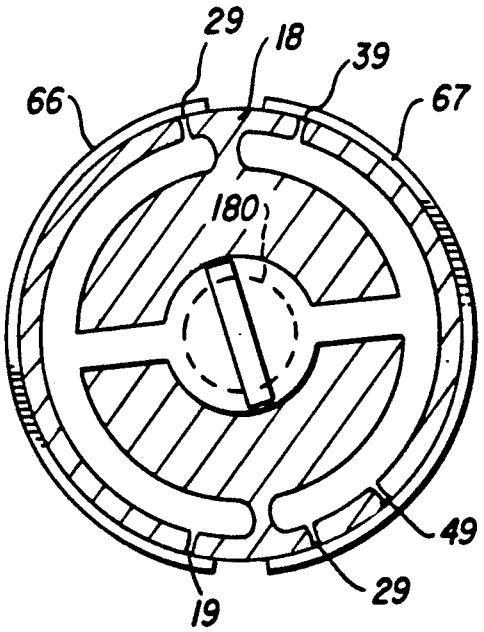
FIG. 3 is a cross-section of a transfer drum shown in FIG. 2.

Transfer drum 18 is best seen in FIGS. 2 and 3. According to FIG. 2, vacuum holes 19 are positioned across the length of drum 18 to grip the leading edge of a receiving sheet. Vacuum is applied to the holes from a source of vacuum shown schematically at 180 through suitable conduits and valves, some of which are not shown. U.S. Pat. No. 4,712,906 is incorporated by reference herein and shows more details of a suitable mechanism for applying and releasing the vacuum at the appropriate times for the holes gripping the leading edges of receiving sheets.

The drum 18 has an aluminum core and a polyurethane outer layer. Preferably, the polyurethane is of an intermediate conductivity, for example, it may have a resistivity of $5\times10^9$ ohms-cm. Transfer rolls having an outer layer or layers of intermediate conductivity are well known and have certain advantages over drums having greater conductivity. The outer layer in the FIGS. is shown as a single layer, but can be more than one. See, for example, U.S. Pat. No. 3,781,105, Meagher, issued Dec. 25, 1973 for a discussion of advantages of intermediate conductivity transfer drums and illustrating use of a two outer layer drum. The polyurethane layer is sufficiently conductive that it helps establish the electrical field urging transfer.

As seen in FIG. 3, vacuum holes 19 grip the leading edge of a first letter sized receiving sheet 66 which encompasses slightly less than half the circumference of the drum 18. The leading edge of a second letter size sheet 67 is gripped by another row of vacuum holes 39. For many grades of paper, vacuum holes for the leading edge are adequate. However, for best holding of a wide grade of materials, including transparency stock, vacuum holes 29 located along the trailing edge of the sheets assist in the holding process, preventing creep of the receiving sheet on the drum surface and thereby preventing misregistration of images. Additionally, a set of vacuum holes 59 (FIG. 2) can be positioned along one or both lateral edges of the image areas to provide additional holding force.

If a ledger sized receiving sheet is to be used, the leading edge is still attached using vacuum holes 19 but, the sheet will stretch across one row of holes 29 and the row of holes 39 ending up short of the second row of holes 29. To secure the trailing edge of ledger sheets an additional row of holes 49 is provided. If the trailing edge of other sizes of sheets (for example, legal size) is to be secured, additional rows of holes for the trailing edges will be necessary.

Thus, even without the holes securing the trailing edges, at least one row of vacuum holes will lie underneath the primary image area during the transfer process of a ledger size sheet. With the additional rows of holes to secure the trailing edge of sheets, the number of holes is multiplied.

Under some conditions, the vacuum holes do not have an adverse effect on the final image. However, for many conditions, especially with a dry receiving sheet, for example, a sheet that has been through a fuser once and is now receiving the second side of a duplex copy or resin sheet used to make a transparency, insufficient transfer is present in the portion of the sheet overlying the vacuum holes. This shows up on a white receiving sheet as a white spot in the image. This phenomena is believed to be due to the fact that transfer is accomplished primarily by a relatively strong electric field between the surface of the drum 18 and a conductive backing for the web 1. In a humid environment, the paper is conductive and provides some continuity of the field over the holes. In dry conditions, the receiving sheet is less conductive and that field loses continuity over the holes. The toner does not transfer, staying on the surface of web 1.

We have found that very small vacuum openings do not create noticeable visual artifacts. We have also found that the diameter of the largest opening that does not show a visible artifact varies inversely with the resistance of the receiving sheet. This is demonstrated in FIG. 4 where the diameter of a vacuum opening which is at the threshold of defect visibility is plotted against the surface resistivity of the receiving sheet. A normal sheet of paper in a relatively humid environment may not show a defect with a vacuum opening as large as 3.0 mm or larger. However, a resin based sheet commonly used for transparencies may still show a defect with openings at or below 0.4 mm in diameter. To handle a variety of paper receivers in the most common dry conditions, the opening should have a diameter less than 1.0 mm. However, for highest quality results in very dry conditions, especially with duplex copies, 0.5 mm to 0.65 mm diameter openings are preferred.

To avoid any visual defects in the least conductive transparencies, opening diameters less than 0.4 mm. are necessary.

Such openings have a tendency to clog with paper dust, toner, fusing oil and the like, especially if smaller than 0.4 mm in diameter. The problem with transparencies can be treated in several ways. Some transparency stock is more conductive, e.g., $10^{13}$ to $10^{14}$ ohms/square in resistivity. Such stock can be used with holes between 0.50 mm and 0.65 mm without the artifact. Even with less conductive stock, the defect with an opening 0.5 to 0.65 mm. in a transparency is a very small defect. If, in the apparatus shown in FIG. 1, most transparency reproductions are letter size, the defect may only occur in the margin of transparencies, and being small may be acceptable. Alternatively, very small 0.4 mm openings can be used. Some of the preferred embodiments of the invention produce openings that small that will not clog in a relatively clean machine environment. For most applications, the former approach with 0.5 to 0.65 mm openings and more conductive transparency stock is preferred.

Openings of the preferred size can be drilled with a laser or other very small diameter drilling device and have been found to work satisfactorily for many applications. However, such small holes are difficult to drill through both an aluminum test core and polyurethane outer layer, especially when 0.65 mm in diameter or smaller. They also have a tendency to clog, as mentioned. A preferred approach to forming the openings is shown in FIGS. 5–13. According to FIG. 6 the surface of drum 18 is defined by a layer 60 of polyurethane into which a large vacuum hole 19 has been drilled. The polyurethane is supported by a cylindrical aluminum core 23 through which the vacuum hole is also drilled. Typically, the resistivity of this polyurethane is $5\times10^9$ ohm-cm and the layer is 4 mm thick. The vacuum hole is of course 4 mm long. Hole 19 is of substantial diameter, for example, 5 mm.

Figure 5:
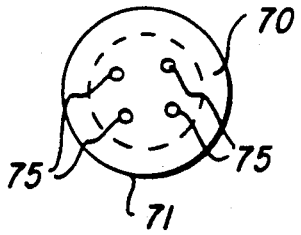
FIG. 5 is a top view of an embodiment of an insert constructed according to the invention.
Figure 6:
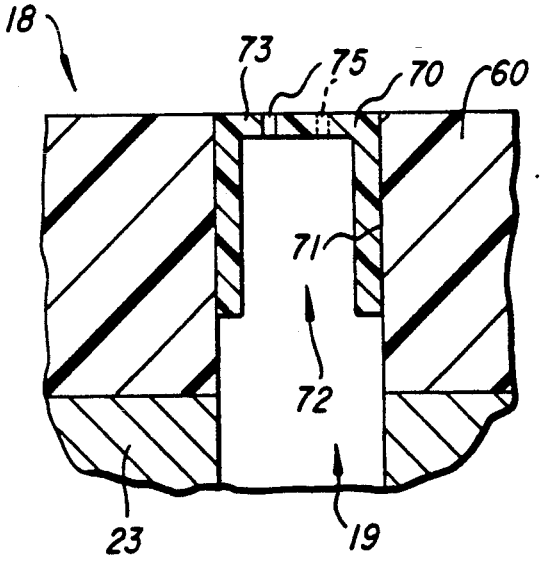
FIG. 6 is a section of the insert shown in FIG. 5 in a vacuum hole in the transfer drum shown in FIG. 3.

A polyurethane insert 70 fits into the hole 19 and is shown in FIG. 5 and in the vacuum hole 19 in FIG. 6. The insert has a cylindrical outer surface 71 which can be affixed to the inside of the hole 19 by a suitable conductive adhesive. The insert has a hollow center 72 which is open at one end and has a closed end 73. The closed end is positioned at the surface of the roller 18. Very small diameter openings 75 are drilled by a conventional drill or cut with a laser through the closed end 73 and into the hollow center 72. These openings are small enough not to show up as artifacts discernible to the human eye in the final image, for example, they can be 0.50 to 0.65 mm in diameter or smaller. They can be made very short in length compared to the overall length of the hole 19 and in fact can be made very short compared to the length of the insert 70. The insert 70 need not be particularly long, except that it should have enough surface contact with the layer 60 through an appropriate conductive adhesive to maintain electrical continuity with it. This allows the insert to maintain the continuity of the electric field which transfers the toner to the receiving sheet in the vicinity of the vacuum hole 19.

Figure 4:
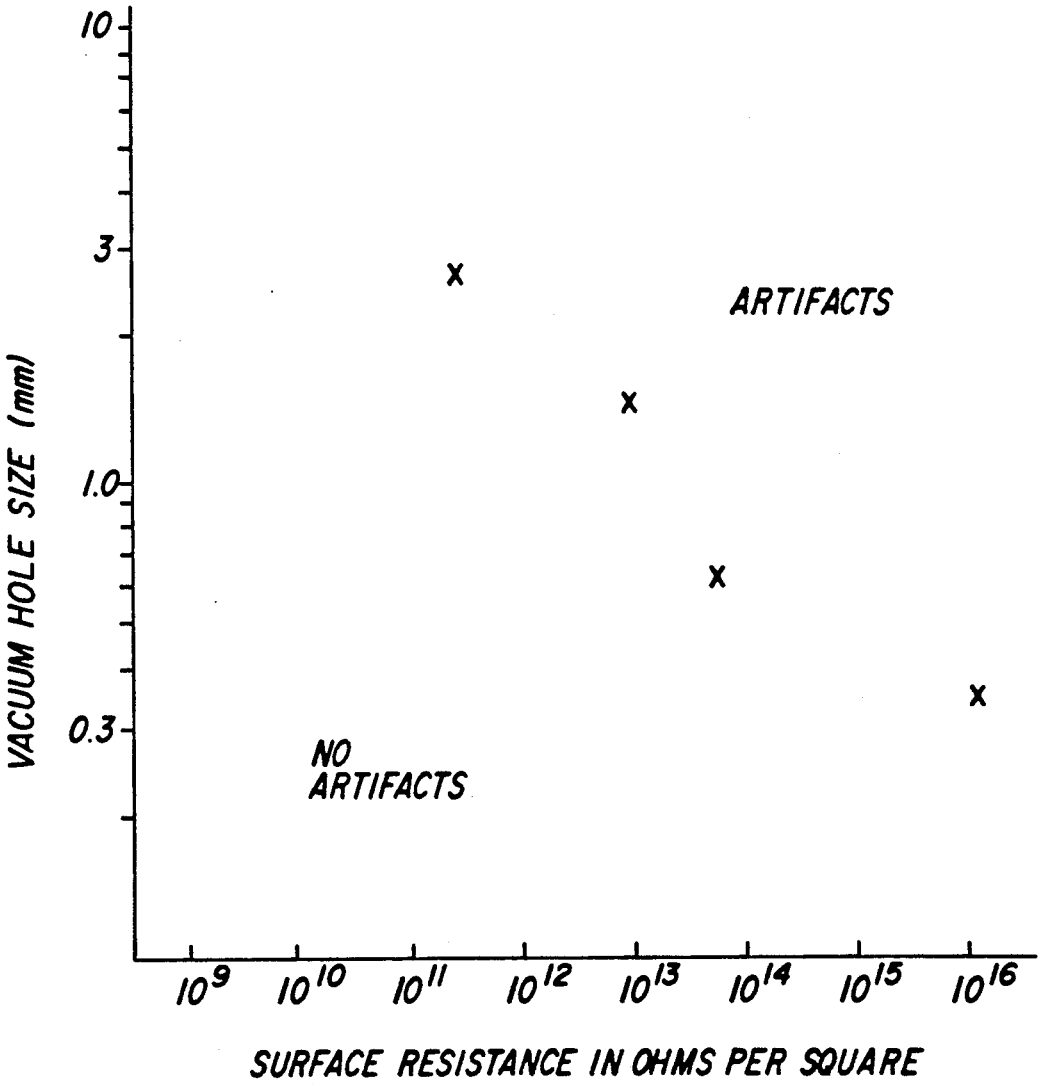
FIG. 4 is a graph illustrating the relationship of vacuum opening size, the presence of artifacts and the surface resistance of the receiving sheet.
Figure 7:
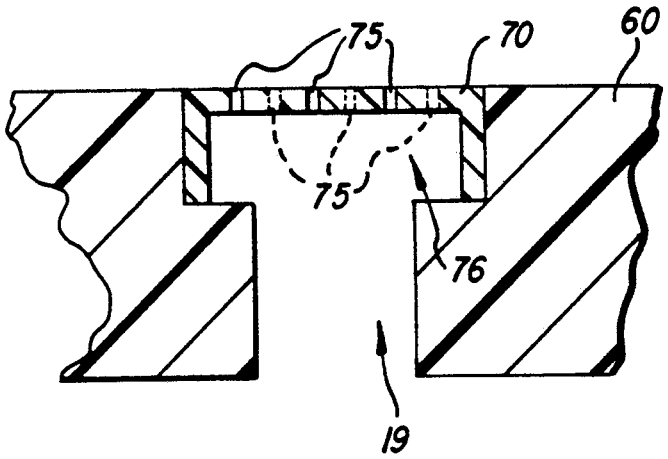
FIG. 7 is a section of another embodiment similar to that shown in FIG. 6.

FIG. 7 shows a cross-section of a variation of the embodiment shown in FIGS. 4 and 5 in which the vacuum hole 19 has two different diameters and the insert 70 is positioned in a wider diameter portion 76 which is essentially a shallow recess surrounding the vacuum hole. This geometry has the advantage of providing a greater number of narrow vacuum openings 75 for each vacuum hole 19 thereby assuring more holding force for the receiving sheet. However, maintenance of good electrical contact is more difficult with the shallow dimension. Maintenance of continuity of the surface of roller 18 is also more difficult. In addition, the two size bore to vacuum hole 19 is more expensive to manufacture.

Figure 8:
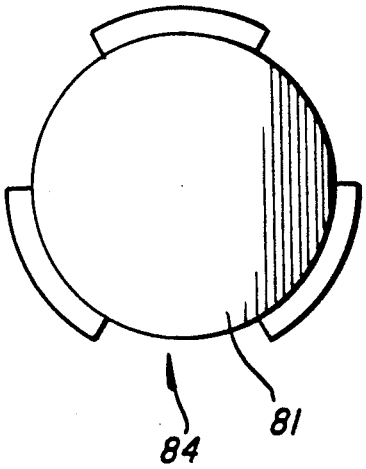
FIGS. 8 and 10 are top and perspective views of another embodiment of an insert constructed according to the invention.
Figure 9:
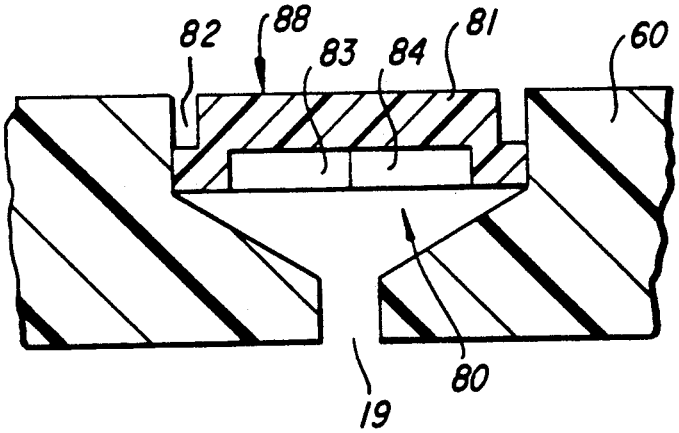
FIG. 9 is a section showing the insert of FIGS. 8 and 10 in a vacuum hole.
Figure 10:
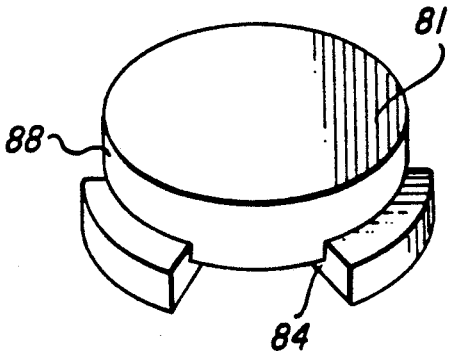

FIGS. 8, 9 and 10 show another embodiment of the invention. According to FIG. 9, the layer 60 has vacuum holes 19 cut in the shape of a countersink, again with the wide portion 80 of the bore at the surface of layer 60. An insert 81 is shown in the wide bore 80 in FIG. 9 and in top and perspective views in FIGS. 8 and 10, respectively. The insert 81 is generally cylindrical in shape with a closed end 88 and a hollow center 83. At least a portion of the closed end is smaller than the rest of the cylinder to form an annular recess 82 (FIG. 9). Hollow center 83 of the insert communicates with recess 82 through holes 84 as best seen in FIG. 10, to provide vacuum openings. This geometry provides excellent holding power with relatively large vacuum openings provided by recess 82 that are not inclined to become stopped up with paper dust, fusing oil or toner. The annular geometry of the hole 82 is more likely to be noticeable in the final image than are the small holes shown in FIGS. 5 and 6. However, a thin annular artifact is not generally as objectionable as a straight artifact and this structure is acceptable for many applications. Again, care must be taken to obtain good conductive contact between the insert 81 and the layer 60 using a suitable conductive adhesive. As in the other examples. the surface of the insert should provide surface continuity with the surface of layer 60 to relatively fine tolerances.

Figure 11:
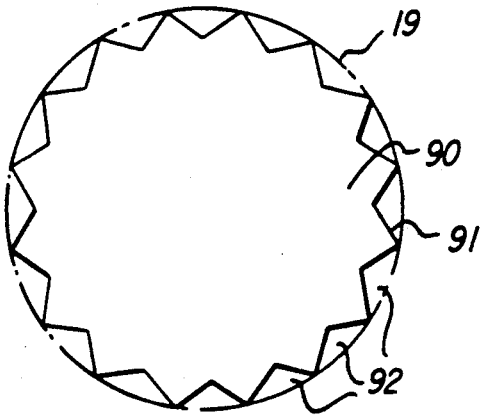
FIGS. 11 and 12 are top end sections, respectively, of another embodiment of the invention with the insert not sectioned.
Figure 12:
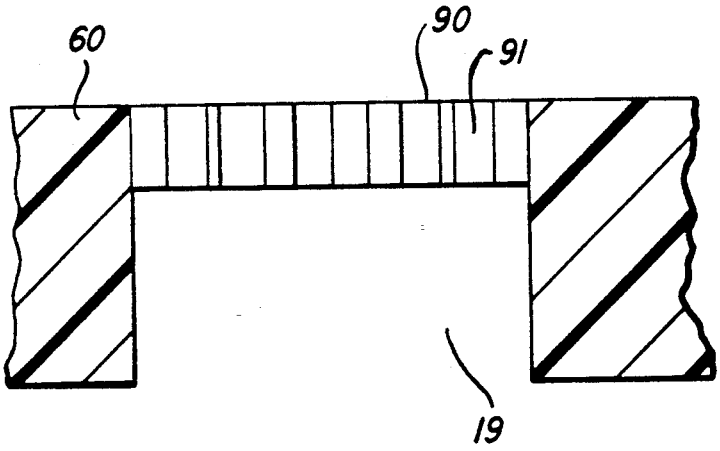
Figure 13:
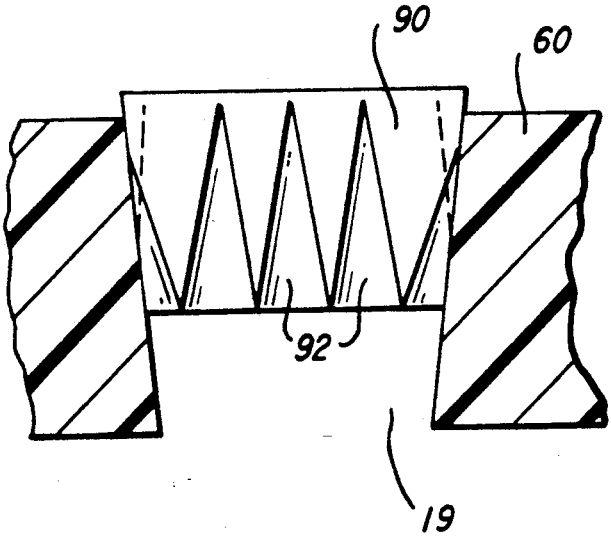
FIG. 13 is a section of another embodiment of the invention with the insert not sectioned.

FIGS. 11, 12 and 13 show two more preferred embodiments of the invention. According to FIGS. 11 and 12, an insert 90 is made of solid conductive material generally cylindrical in shape. However, the exterior surface 91 of the insert 90 has a knurled, splined or serrated exterior. It combines with the inner surface of vacuum hole 19 to form small vacuum openings 92. If a cross-section of hole 19 is circular, the insert is sufficiently acircular to provide the vacuum openings with the wall of hole 19.

This structure has the advantage of ease in manufacture and assembly. The knurled or serrated surface can be molded using a variety of techniques. It also provides a large number of vacuum openings 92 for each vacuum hole 19. However, the length of the openings 92 are necessarily as long as the insert. Therefore, if the insert is made of substantial length in order to assure good electrical contact with layer 60, the openings 92 must then be of the same length. For any given application, an appropriate tradeoff between short openings 92 for freedom from clogging and length of inserts 90 for good adhesion must be made and is within the skill of the art.

FIG. 13 shows a variation of FIGS. 11 and 12 in which the ridges or serrations are tapered along the length of the hole to provide vacuum openings that are wider at the bottom and narrower at the top. Like the insert shown in FIGS. 11 and 12, this insert is also relatively easy to make and improves the above-described tradeoff associated with maintenance of conductivity between the insert and the layer 60 and the clogging of the openings 92 when extended over a long distance. The wide base lessens clogging despite relatively long openings. Narrow tops reduce the artifact. The longer length of the opening increases the area of contact of the insert with layer 60, i.e., the side walls of holes 19.

However made, openings that are wide at the bottom and narrow at the surface of the drum, improve the tradeoff between clogging and artifact reduction.

FIG. 13 also shows another aspect of the invention that can be used with all embodiments. The hole 19 is tapered slightly. Insert 90 is also tapered and is inserted with a slight portion protruding. The protruding portion is then ground down to be flush with the surface of the layer 60 thereby providing surface continuity for the receiving sheet that is to be attached to it and also exposing the ends of openings 92. The inserts shown in the other FIGS. can also be inserted with a small portion protruding after the adhesive has been applied, with or without the tapering. That portion is then ground down to be flush with the surface of layer 60. Continuity of the surface of the layer 60 is important to high quality image transfer. This grinding process can be part of a final grinding of the entire outer surface of layer 60.

Figure 14:
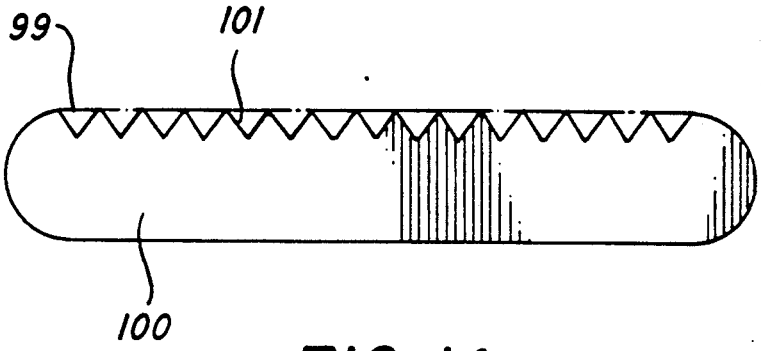
FIGS. 14 and 15 are top views of another embodiment of the invention.
Figure 15:
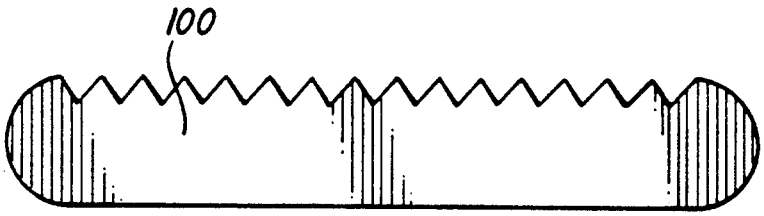

FIGS. 14 and 15 show another variation on FIGS. 11-13. In this embodiment vacuum hole 99 is oblong through both the polyurethane and aluminum portions of the drum. An insert 100 is also oblong in shape to fit the hole 99, except that one side 101 is saw toothed to form a row of openings with one wall of hole 99. This insert could also be formed to provide conically shaped openings wider at the bottom as in FIG. 12.

This embodiment has the advantage of forming a row of openings than can be positioned as close as possible to the edge of the receiving sheet. A straight row has been found to provide more useful holding force than similarly sized openings arranged in a circle, because of the ability to apply them all close to the edge of the sheet. Thus, the side 101 is substantially straight and fits a substantially straight portion of the wall of the hole 99. For this embodiment, the row of openings is substantially parallel to a transverse edge of a receiving sheet, i.e., it is substantially parallel to the axis of the drum.

Although not absolutely required, it is preferable to match up the conductivity of the insert accurately with the conductivity of the layer 60. Thus, if layer 60 has an intermediate conductivity in the neighborhood of $5\times10^9$ ohm-cm and is made of a polyurethane, it is preferable that the inserts be made of a similar material. Best results are obtained by making the inserts from the same exact source as the layer. For example, if the material for layer 60 is made in a batch process in which a conductive additive provides a desired intermediate level of conductivity, the inserts are preferably made from the same batch to closely match the conductivity of the layer.

This invention is particularly useful in the structure described above where the vacuum holes may be required in the middle of image elements. However, it can also be used effectively where only vacuum holes in the leading edges of documents are used since the leading edges may on occasion contain some image portions.

The invention has been described in detail with particular reference to a preferred embodiment thereof, but it will be understood that variations and modifications can be effected within the spirit and scope of the invention as described hereinabove and as defined in the appended claims.

We claim:

1. Apparatus for transferring a toner image from an image-bearing member to a receiving sheet, which apparatus includes:

a transfer member having a conductive surface and having vacuum holes to said surface, means for applying a vacuum to said vacuum holes to hold a receiving sheet on the surface of the member, means for creating an electric field urging a toner image toward said transfer member, and a conductive insert positioned in each of said vacuum holes, said insert being sufficiently conductive to improve the continuity of said electric field and having or defining with the inside of the vacuum hole small vacuum openings thinner in cross section than said vacuum hole.

2. Apparatus for transferring a toner image from an image-bearing member to a receiving sheet, which apparatus includes:

a transfer drum having an outer surface formed by a layer of conductive material having a given thickness, said layer having vacuum holes to said surface, means for applying a vacuum to said vacuum holes to hold a receiving sheet on the surface of the drum, means for creating an electric field urging a toner image toward said drum, and a conductive insert positioned in each of said vacuum holes, said insert being generally hollow but having a closed end generally coplanar with the outer surface of the drum, the closed end having small vacuum openings through said closed end, said openings having a length substantially less than the thickness of the outer layer of the drum.

3. The apparatus according to claim 2 wherein the insert is adhesively fixed to the wall of the vacuum holes using a conductive adhesive.

4. The apparatus according to claim 2 wherein the insert is of substantially the same conductivity as the conductive layer.

5. The apparatus according to claim 2 wherein the vacuum openings are shorter than the length of the insert.

6. Apparatus for transferring a toner image from an image bearing member to a receiving sheet, which apparatus includes:

a transfer drum having a conductive surface formed by a conductive layer having a given thickness, said layer having vacuum holes to said conductive surface, which vacuum holes have a particular cross-sectional shape, means for applying a vacuum to said vacuum holes to hold a receiving sheet on the surface of the drum, means for creating an electric field urging a toner image toward said drum, and a conductive insert positioned in each of said vacuum holes, said insert being sufficiently conductive to improve the continuity of said electric field and having a cross-sectional shape sufficiently different from the cross-sectional shape of said hole to form with the inner surface of the vacuum hole small vacuum openings sufficiently large to maintain a vacuum at the surface of the transfer drum.

7. The apparatus according to claim 6 wherein the outer surface of the insert facing the inside surface of the vacuum hole is knurled, splined or serrated.

8. The apparatus according to claim 6 wherein the outer surface of the insert is saw-toothed with respect to the inside surface of the vacuum hole.

9. The apparatus according to claim 6 wherein the outer surface of the insert which contacts the inner surface of the vacuum hole is shaped to form vacuum openings with said inner surface that are wider at their end away from the outer surface of the drum and narrower at the surface of the drum.

10. The apparatus according to claim 6 wherein said vacuum holes are circular in cross-section.

11. The apparatus according to claim 6 wherein the wall defining said vacuum hole has a cross-section at the surface of the drum having substantially straight portion and said insert has a portion which mates with said straight portion which insert portion is shaped to define with said straight portion a row of vacuum openings which row is substantially straight at the surface of the drum.

12. The apparatus according to claim 11 wherein said substantially straight portion is positioned on said drum to be substantially paralell to a transverse edge of a receiving sheet to be held thereby.

13. Apparatus for transferring a toner image from an image bearing member to a receiving sheet, which apparatus includes:

a transfer drum having a conductive surface formed by a conductive layer having a given thickness, said layer having vacuum openings to said conductive surface, said vacuum openings being wider at their end away from the surface than they are at the surface.

14. Apparatus for transferring a toner image from an image-bearing member to a receiving sheet, which apparatus includes:

a transfer drum having a conductive surface formed by a conductive outer layer having a given thickness, said layer having vacuum holes to said surface, means for applying a vacuum to said vacuum holes to hold a receiving sheet on the surface of the drum, means for creating an electric field urging transfer of a toner image to a receiving sheet so held, and a conductive insert positioned in said vacuum holes the insert having a cylindrical outer surface,, a hollow center with one closed end, at least a portion of said closed end having a diameter smaller than the cylindrical outer surface to form an annular recess from the inner wall of the vacuum hole, and said insert further having at least one vacuum opening between the annular recess and the hollow center.

15. Apparatus for forming multicolor toner images on a receiving sheet, said apparatus including means for forming a series of electrostatic images on an image bearing member, means for toning said electrostatic images with toners of different colors, and means for transferring a plurality of said images to a receiving sheet in registry with each other image, to form a multicolor image on said receiving sheet, said transferring means including a transfer member having a conductive surface and having vacuum holes to said surface, means for applying a vacuum to said vacuum holes to hold a receiving sheet on the surface of the member, means for creating an electric field urging a toner image toward said transfer member, and a conductive insert positioned in each of said vacuum holes, said insert being sufficiently conductive to improve the continuity of said electric field and having or defining with the inside of the vacuum holes small vacuum openings thinner in cross section than said vacuum hole.

16. Apparatus according to claim 15 wherein said transfer member is a transfer drum having at least two sets of vacuum holes formed in straight lines running parallel to its axis, one to hold the leading edge of each of two receiving sheets.

17. Apparatus for transferring a toner image from an image-bearing member to a receiving sheet, which apparatus includes:

a transfer member having an outer layer of material sufficiently conductive to help form an electric field, said layer having an outer surface, and said member having vacuum openings through said layer to said surface, means for applying a vacuum to said vacuum openings to hold a receiving sheet on the surface of the member, and means utilizing said layer for creating an electric field urging a toner image toward said transfer member, characterized in that said vacuum opening has a cross-sectional dimension at said surface that is less than 1.0 mm.

18. The apparatus according to claim 17 wherein said largest cross-sectional dimension is between 0.50 mm and 0.65 mm.

19. Apparatus for transferring a toner image from an image bearing member to a receiving sheet, which apparatus includes:

a transfer drum having a conductive surface formed by a conductive layer having a given thickness, said layer having vacuum openings to said conductive surface, said vacuum openings being generally tapered, with the cross-section of the opening at the surface of the layer having a maximum dimension less than 1.0 mm and the other end of the opening having a maximum dimension larger than the maximum such dimension at the surface.

20. Apparatus for forming multicolor toner images on a receiving sheet, said apparatus including means for forming a series of electrostatic images on an image bearing member, means for toning said electrostatic images with toners of different colors, means for transferring a plurality of said images to a receiving sheet in registry with each other image, to form a multicolor image on said receiving sheet, said transferring means including a transfer member having an outer layer of material sufficiently conductive to help form an electric field, said layer having an outer surface, and said member having vacuum openings through said layer to said surface, means for applying a vacuum to said vacuum openings to hold a receiving sheet on the surface of the member, and means utilizing said layer for creating an electric field urging a toner image towards said transfer member, characterized in that each of said vacuum openings has a cross-sectional dimension at said surface that is less than 1.0 mm.

21. Apparatus according to claim 20 wherein said transfer member is a transfer drum having at least two sets of vacuum holes formed in straight lines running parallel to its axis, one to hold the leading edge of each of two receiving sheets.

22. A transfer drum having an outer layer of material sufficiently conductive to help form an electric field, said layer having an outer surface, and said drum having vacuum openings through said layer to said surface, said openings being less than 1.0 mm in diameter at their narrowest.

23. A transfer drum according to claim 22 wherein said diameter is between 0.50 and 0.65 mm.

24. A transfer drum according to claim 22 wherein said openings are larger at their base than they are at the surface of said drum.

* * * * *